US005383975A

United States Patent [19]

Faxon

[11] Patent Number: 5,383,975

[45] **Date of Patent: * Jan. 24, 1995**

[54] ARRANGEMENT FOR CLEANING OF PIPELINES

[76] Inventor: Johan Faxon, Box 3109, S-903 03 Umeå, Sweden

[ * ] Notice: The portion of the term of this patent subsequent to Mar. 22, 2011 has been disclaimed.

[21] Appl. No.: 30,339

[22] PCT Filed: Sep. 30, 1991

[86] PCT No.: PCT/SE91/00655

§ 371 Date: Mar. 25, 1993

§ 102(e) Date: Mar. 25, 1993

[87] PCT Pub. No.: WO92/05888

PCT Pub. Date: Apr. 16, 1992

[30] Foreign Application Priority Data

Oct. 4, 1990 [SE] Sweden ..... 9003183

[51] Int. Cl.[6] ..... B08B 9/00; B08B 9/02; B08B 9/04; B08B 5/02

[52] U.S. Cl. ..... 134/22.11; 134/22.12; 134/22.18; 134/24; 134/34; 134/167 C; 134/172; 134/179; 15/304; 15/394; 15/405

[58] Field of Search ..... 134/22.11, 22.12, 22.18, 134/24, 34, 167 C, 172, 179; 15/304, 394, 405

[56] References Cited

U.S. PATENT DOCUMENTS

| | | | |
|---|---|---|---|
| 4,841,999 | 6/1989 | Danko | 134/22.12 |
| 5,003,998 | 4/1991 | Collett | 134/22.12 |
| 5,143,105 | 9/1992 | Katayama | 134/179 |

FOREIGN PATENT DOCUMENTS

| | | |
|---|---|---|
| 9003183 | 10/1990 | Sweden . |
| 1530308 | 10/1978 | United Kingdom . |
| WO91/13699 | 9/1991 | WIPO . |

*Primary Examiner*—Richard O. Dean
*Assistant Examiner*—Zeinab El-Arini
*Attorney, Agent, or Firm*—Watson, Cole, Grindle & Watson

[57] ABSTRACT

An arrangement is provided for cleaning pipelines and especially ventilation pipes and ducts in buildings, and includes a nozzle connected to a supply conduit through which a pressurized medium can flow. The arrangement includes a nozzle opening directed back toward the supply conduit. The nozzle opening is in the form of a large continuous annular gap which extends along the periphery of the nozzle and is connected to the supply conduit and the source of a pressurized medium. The gap directs the medium toward the inner walls of the pipe or duct and effects a cleaning of the inner walls. The nozzle is moved into the pipe or duct as a result of reaction forces generated from discharge of the pressurized medium through the nozzle opening.

7 Claims, 5 Drawing Sheets

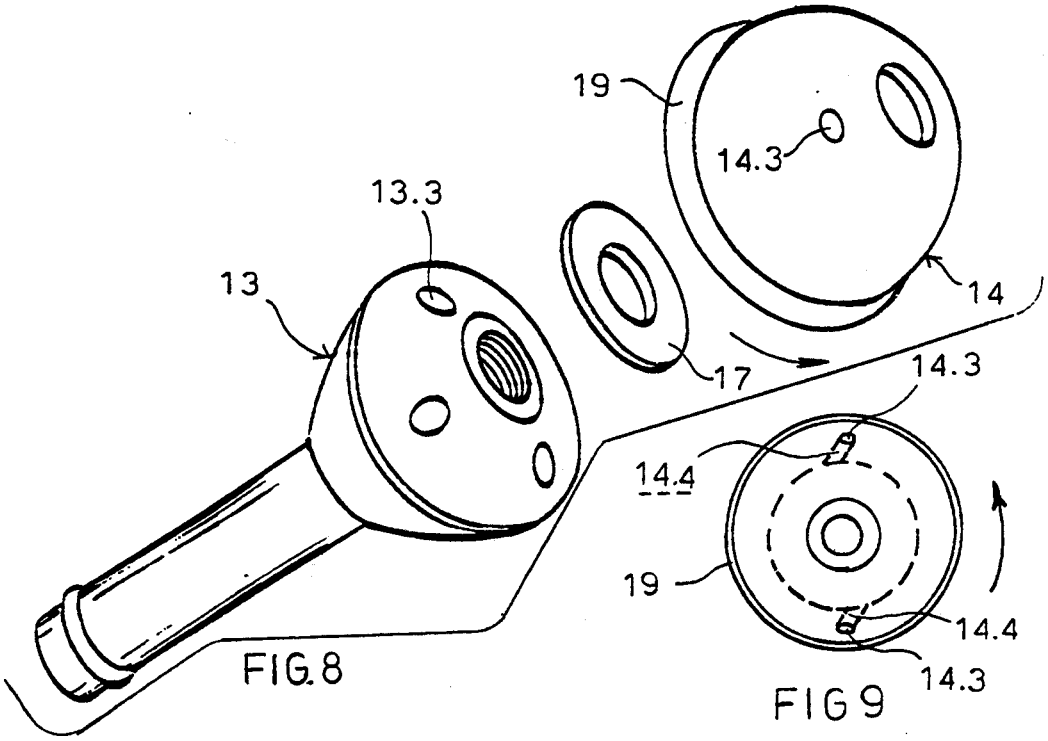
FIG.8
FIG 9
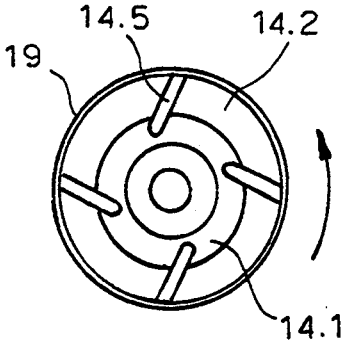
FIG10
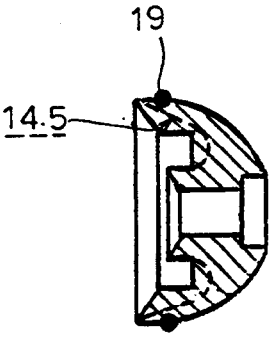
FIG 11
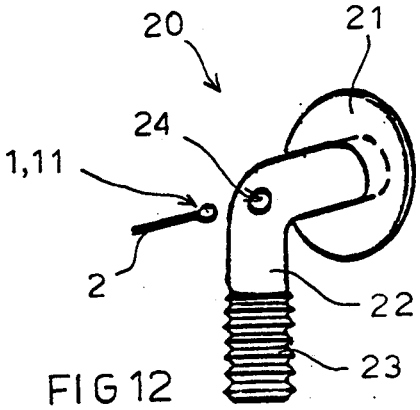
FIG 12
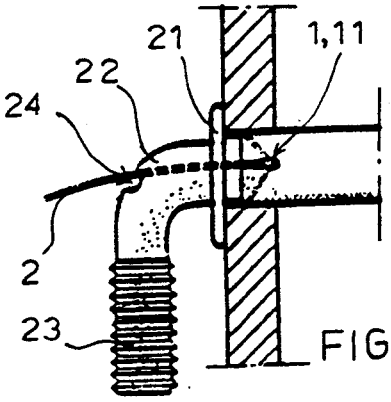
FIG 13

ARRANGEMENT FOR CLEANING OF PIPELINES

FIELD OF THE INVENTION

The present invention relates to an arrangement for cleaning of pipe lines, and especially ventilation pipes and ventilation ducts of large cross-sectional area in buildings, and comprises a cleaning means which is connected to a source of pressure medium, for example a compressed air compressor via a supply conduit, and which exhibits one or more nozzle openings which are directed backwards towards the supply conduit at an acute angle relative to a centre line which extends through the fastening of the supply conduit in the cleaning means.

BACKGROUND OF THE INVENTION

The object of the present invention is to provide an arrangement according to the preamble, and which produce a satisfactory cleaning of pipe lines of loose dust, deposits and other contaminants plus disinfection of the lines also. The invention primarily aims to provide cleaning of ventilation pipes and ventilation ducts, but being able to clean of contaminants all types of conduits.

SUMMARY OF THE INVENTION

These objectives are achieved with the present invention which is characterized in that a cleaning means in the arrangement shows a nozzle opening in the form of a largely continuous annular gap which extends along the outermost periphery of the cleaning means and which is connected to the supply conduit and the source of pressure medium via one or more ducts which are arranged within the cleaning means, and where the medium is made to flow out through the annular gap and partly clean inner walls of the conduit, partly by way of forces of reaction from the outflowing medium make the cleaning means moving into the pipe line. The remaining characterizing features of the invention will be evident from the patent claims.

On cleaning of a pipe line a coupling arrangement is arranged on an inspection opening, exhaust valve or the like, and which seals against the opening in the pipe line. A cleaning means according to the invention which is arranged in the one end of a flexible hose, is introduced through an insertion opening in the coupling arrangement and into the pipe line. The coupling arrangement is coupled by means of a conduit to a vacuum cleaner arrangement or the like, which is utilised to establish a reduced pressure in the pipe line. A pressure medium, for example compressed air or steam is fed to the cleaning means, which by forces of reaction from the outflowing medium brings the cleaning means to move into the pipe line thereby causes the cleaning means to move into the pipe line and convey with it the supply conduit for the pressure medium, so that as a consequence of the high speed of discharge, the outflowing medium loosens dust, deposits and other contaminants on inner wall of the pipe line. The dust or the deposits are thereafter sucked out by means of the vacuum cleaner arrangement.

It has been found practical to conduct the cleaning in several steps, the first step consisting in making the cleaning means to move through the pipe line during feeding of a solvent. In this step the primary objective is not to loosen dust and detach deposits in the pipe line by means of the mechanical finishing ability of the air, but to feed a cleaning agent which contributes to the solubility of the deposits. The second step consists in making the cleaning means to move through the pipe line under full pressure of the pressure medium, the speed of the cleaning means being regulated by braking the introduction of the supply conduit in the pipe line. The dust and the deposits are consequently released by means of the cutting action which is produced by the medium which discharges from the annular gap on the cleaning means, but also as a consequence of the irregular movements of the cleaning means and impacts against inner walls of the pipe line. The cleaning means also can be made to move in a rotating movement by twisting of the supply conduit cyclically a number of rotations first in one direction and thereafter in an equal number of turns in the opposite direction during the course of cleaning. When the cleaning means is introduced to a desired position in the pipe line the supply of pressure medium is cut off so that the cleaning means can be drawn out of the pipe line without needing to overcome the force of reaction from the medium which discharges from the annular gap. Alternatively the medium can be caused to discharge from the annular gap at a lower speed when the cleaning means is to be drawn out of the pipe line.

In an alternative embodiment of the invention the front piece of the cleaning means is caused to rotate by forces of reaction from the pressure medium flowing out from openings in the front piece since the cleaning means is caused to rotate in a permanent contact with the inner walls in a helical movement during the introduction in the pipe line.

On cleaning of ventilation pipes and ventilation ducts in buildings pressure medium is preferably utilised in the form of air which can be mixed with solvent or disinfectant in the different cleaning steps. Even steam can be utilised as pressure medium since the width of the annular gap in the cleaning means can be reduced and produces a smaller discharge from the annular gap compared with the case where compressed air is utilised. It also lies within the scope of the invention to be able to combine the utilisation of compressed air and steam since the solvent and disinfectant can be fed to the pipeline by means of compressed air while the actual cleaning is carried out by means of steam at high pressure, for example at 180 kp/cm$^2$.

The cleaning means according to the invention includes a mixing chamber in which the solvent or disinfectant added to the pressure medium is mixed intensively before the mixture discharges from the annular gap on the cleaning means. By this an uniform distribution of solvent resp. disinfectant in the pipe line is achieved.

Further features and advantages of the cleaning means according to the invention are evident from embodiments described subsequently.

BRIEF DESCRIPTION OF THE DRAWINGS

The invention will be described in the following text in the form of an embodiment in combination with the accompanying drawings.

FIG. 8 shows a perspective view of the cleaning nozzle according to FIG. 7.

FIG. 9 shows a front view of the cleaning nozzle according to FIGS. 7 and 8.

FIGS. 10 and 11 show a part of the cleaning nozzle according to FIGS. 7 and 8 in an alternative design.

FIGS. 12 and 13 show the utilisation of the cleaning arrangement during cleaning of a ventilation duct.

DETAILED DESCRIPTION OF THE INVENTION

Figure 1:
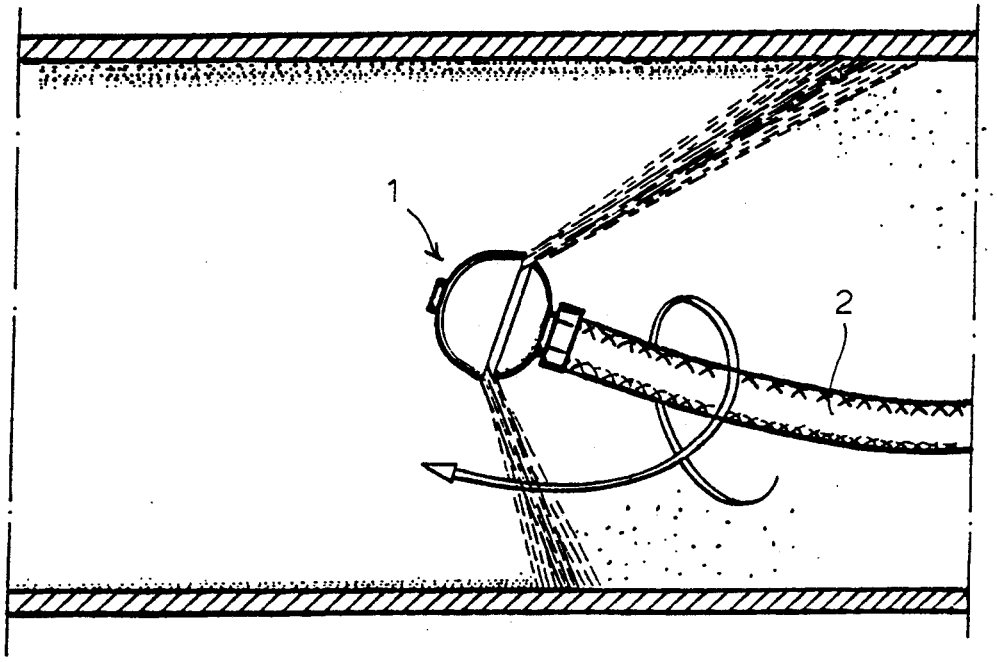
FIG. 1 shows a cleaning arrangement according to the invention in operation in a pipe-shaped duct illustrated in a longitudinal section.
Figure 2:
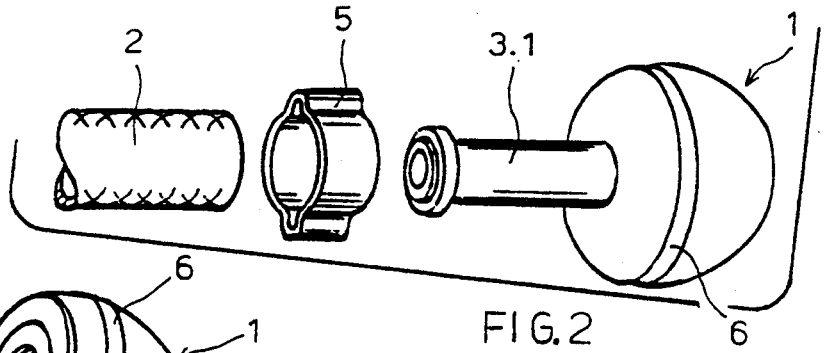
FIG. 2 shows a cleaning nozzle in the arrangement according to FIG. 1 which is adapted for coupling of a hose.
Figure 3:
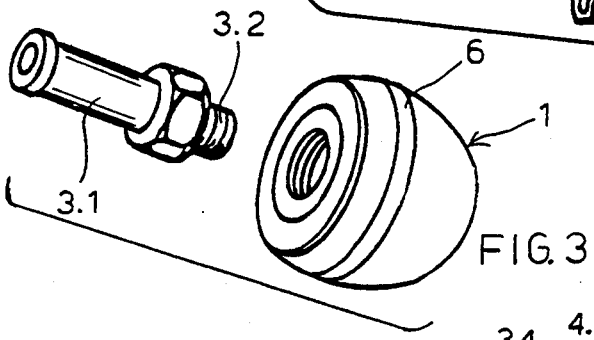
FIG. 3 shows an alternative design of the hose coupling according to FIG. 2.
Figure 4:
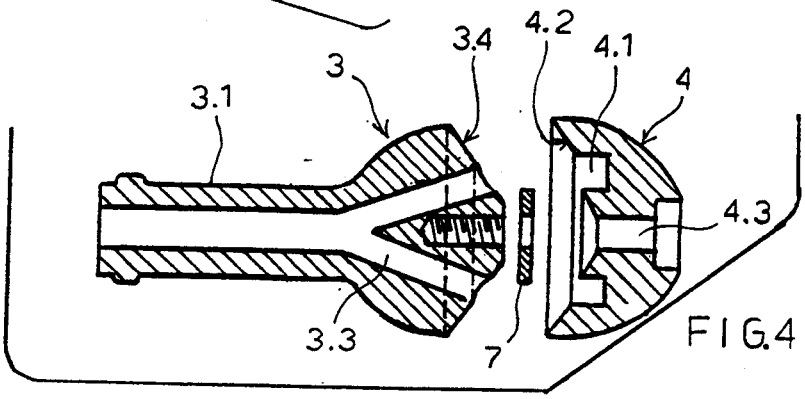
FIG. 4 shows a longitudinal section through the cleaning nozzle according to FIG. 2, partly disassembled.
Figure 5:
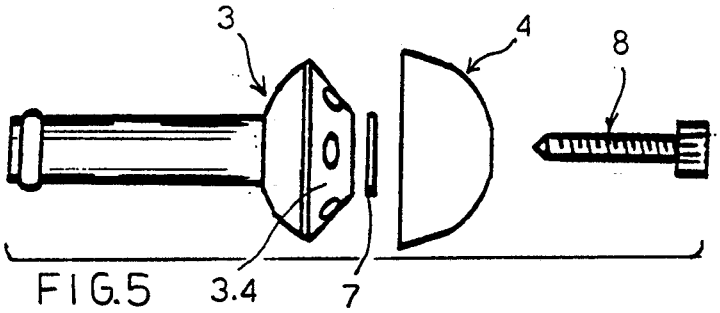
FIG. 5 shows a side view of the cleaning nozzle according to FIG. 4.
Figure 6:
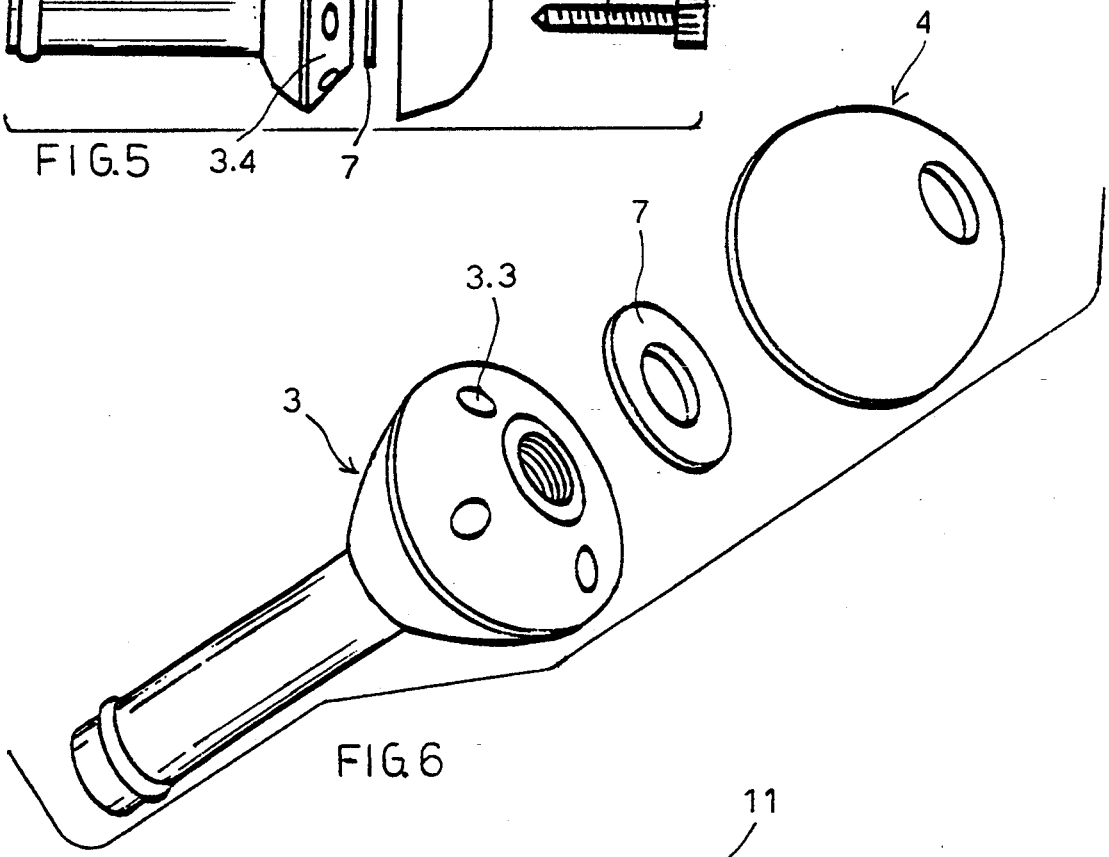
FIG. 6 shows a perspective view of the cleaning nozzle according to FIG. 5.
Figure 7:
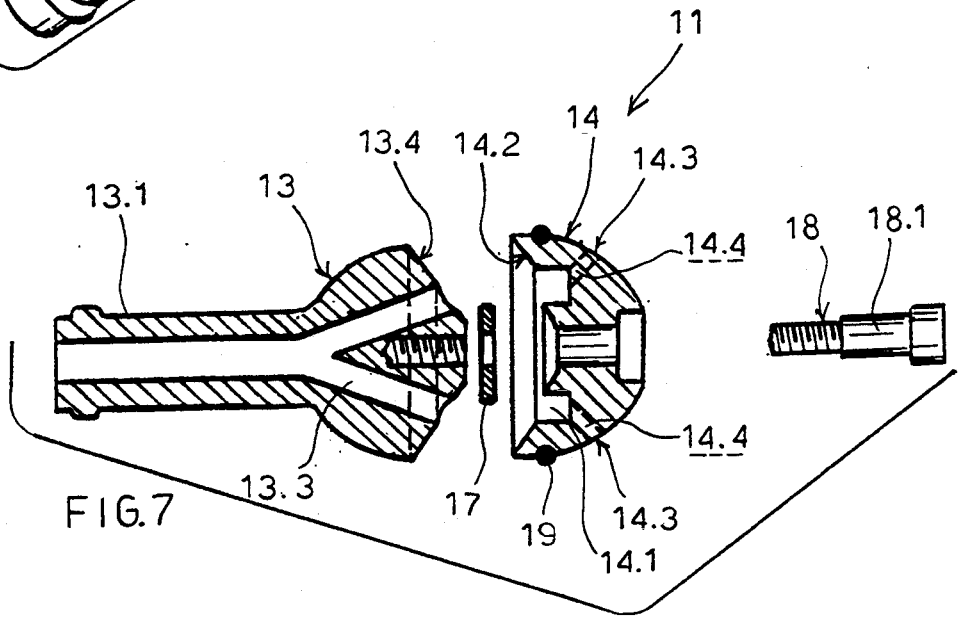
FIG. 7 shows an alternative design of the cleaning nozzle according to the invention in a longitudinal section and partly disassembled.
Figure 14:
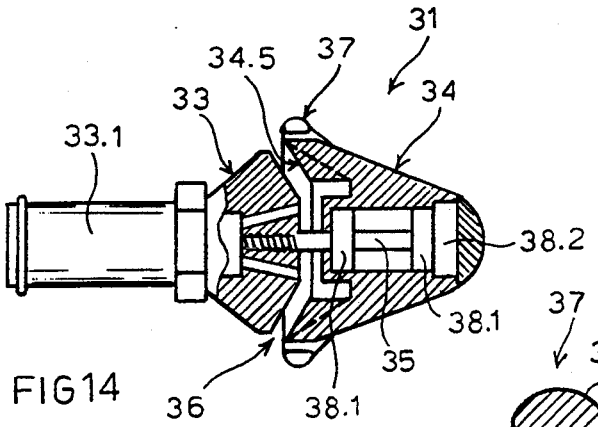
FIG. 14 shows another longitudinal section of an alternative design of the cleaning nozzle according to the invention.
Figure 15:
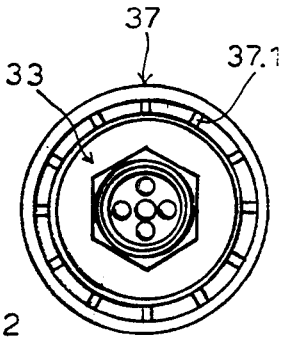
FIG. 15 shows a back view of the cleaning nozzle according to FIG. 14.

The cleaning arrangement which is illustrated in FIGS. 1–6 comprises a cleaning nozzle 1, which is fixedly arranged in the end of a flexible hose 2 for feeding compressed air to the nozzle. The hose 2 is fastened on the cleaning nozzle 1 by means of a hose clamp 3. The parts are shown disassembled in FIG. 2. In FIG. 1 the cleaning arrangement is shown inserted in a pipe-shaped duct where dust and deposits are to be removed from walls of the duct. The cleaning nozzle 1 includes a rear piece 3 and a front piece 4 dismantleable from this. The rear piece 3 is provided with a coupling pipe 3.1 to which the hose is secured by means of a hose clamp 5. The coupling pipe 3.1 can constitute an integrated portion of the rear piece 3, such as is shown for example in FIGS. 2 and 4, or it can be secured with a suitable pin 3.2 such as is shown in FIG. 3. The rear piece 3 exhibits four distribution holes 3.3 which are arranged symmetrically about its central axis, something which for one thing is evident from FIG. 6, and the holes 3.3 are connected to the coupling pipe 3.1 and discharge into the forward end of the rear piece directed towards the front piece 4. The front piece 4, which largely has the shape of a hemisphere, shows a mixing chamber 4.1 which extends symmetrically about its central axis and which has the same radius which the distribution holes 3.3 are arranged with around the axis. The function of the mixing chamber 4.1 will be described further below. The rear piece 3 furthermore presents an external conical surface 3.4, which extends along its periphery at its front end, and which corresponds to an internal conical surface 4.2 on the front piece, the assembled cleaning nozzle 1 exhibiting an annular gap 6 along the periphery of the nozzle which is directed back out towards the coupling piece 3.1. The width of the annular gap 6 can be regulated by means of a washer 7 the thickness of which determines the width of the gap so that a thicker washer 7 gives a wider annular gap 6. The front piece 4 is fixedly mounted on the rear piece 3 by means of a screw 8 which passes through a central hole 4.3 in the front piece 4 and,is screwed into a threaded hole 3.5 in the rear piece 3.

An alternative design of a cleaning nozzle 11, which is shown in FIGS. 7–10, includes a rear piece 13 and a front piece 14 rotatable mounted on the rear part 13. The rear piece 13 is provided with a coupling pipe 13.1 for the hose on which the cleaning nozzle 11 is to be arranged and showing four symmetrically around its central axis arranged distribution holes 13.3, arranged as in the design described above. The front piece 14 shows a mixing chamber 14.1 as in the design described above. The rear piece 13 and the front piece 14 also show corresponding conical surfaces 13.4, 14.2 which assembled make the cleaning nozzle exhibiting an annular gap 16 along the periphery of the nozzle which is directed backwards. As in the design described above the width of the annular gap 16 can be regulated by means of a washer 17.

The front piece 14 is rotatable mounted on the rear piece 13 by means of a screw 18 which close to its head shows a cylindrical portion 18.1 in the shape of a spindle around which the front piece can rotate. The portion 18.1 has a larger diameter and the corresponding hole in the washer 17 and a length permitting a rotation without play which makes the screw 18 to be driven to the rear piece 13 and the washer 17 completely at mounting. The front piece 14 also shows two diametrically, mainly tangentially to an inner circle directed outlet openings 14.3 extending in a plane on each side of a diameter plane through the central axis of the cleaning nozzle to in an angle of 5°–10° to this plane. Each outlet opening 14.3 is connected to the mixing chamber 14.1 by bores 14.4. By forces of reaction from the air exiting from the outlet openings 14.3 the front piece 14 is imparted a rotation relative to the rear piece 13. A friction ring 19 of rubber is arranged in a groove along the periphery of the front piece 14 by means of which the rotation of the front piece 14 can be transmitted to a movement of the complete cleaning nozzle 11 along the inner wall of a duct In an alternative design the outlet openings 14.3 and the bores 14.4 are replaced by inner open grooves 14.5 shown in FIG. 10, in which the front piece 14 is seen in a direction to its front end. The grooves 14.5 extend in the conical surface 14.2 at the inner end of the front piece 14 a distance into the mixing chamber 14.1 in the front piece 14 and is located in a plane on each side of a diametrical plane through the central axis of the cleaning nozzle in an angle of 5°–10° to this plane. A part of the front piece 14 in a longitudinal section is shown in FIG. 11. Preferably 6–8 grooves are uniformly distributed around the periphery of the front piece 14.

During cleaning of a pipe-shaped ventilation duct, such as is shown in FIG. 1, an exhaust valve for example is replaced with a coupling arrangement 20 as is illustrated in FIGS. 12 and 13. The coupling arrangement 20 presents a flange 21 sealed against a wall and a bent pipe 22 projecting outwardly from the flange to which there is coupled a suction hose which connects the bent pipe to a vacuum cleaner arrangement or the like. The bent pipe 22 shows an insert opening 24 situated in the extension of the centre line to the horizontal portion of the bent pipe 22 in FIGS. 11 and 12, and through the opening is inserted the cleaning nozzle 1, 11 with the hose 2. The cleaning operation consists in that the cleaning nozzle 1, 11 after the insertion in the ventilation duct which is to be cleaned, is fed with compressed air which if desired is fed with a cleaning agent and/or a disinfectant. At high speed compressed air consequently discharges back out from the annular gap along the periphery of the cleaning nozzle 1, so that the nozzle is driven into the duct as a result of the forces of reaction from the discharging air, and carries the hose 2 with it. Simultaneously the suction hose 23 is placed under reduced pressure so that dust which is released from inner walls of the duct is sucked away from the duct and is collected in the vacuum cleaner arrangement which moreover is not shown in the Figures.

When the cleaning nozzle 1 is brought into the duct it is caused to contact the inner walls of the duct by an action of ejection. By twisting the hose 2 sideways the cleaning nozzle 1 according to the first design mentioned is caused to move sideways in the duct on the same time as it is caused to move ahead in the duct by its own force or eventually also backwards in the duct by pulling the hose. At the use of the cleaning nozzle 1 first scribed above dust and existing deposits are released from inner walls of the duct partly as a result of the cutting effect which is produced by the air discharging from the annular gap 6, and partly as a result of irregular movements of the cleaning nozzle 1 and impacts against inner walls of the duct. At using the cleaning nozzle 11 in the alternative design the front piece 14 of the cleaning nozzle 11 also is caused to rotate, which movement is transferred into a movement of the entire cleaning nozzle 11 along the walls of the duct.

Figure 16:
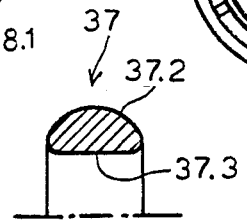
FIG. 16 shows a part of the cleaning nozzle according to FIGS. 14 and 15.
Figure 17:
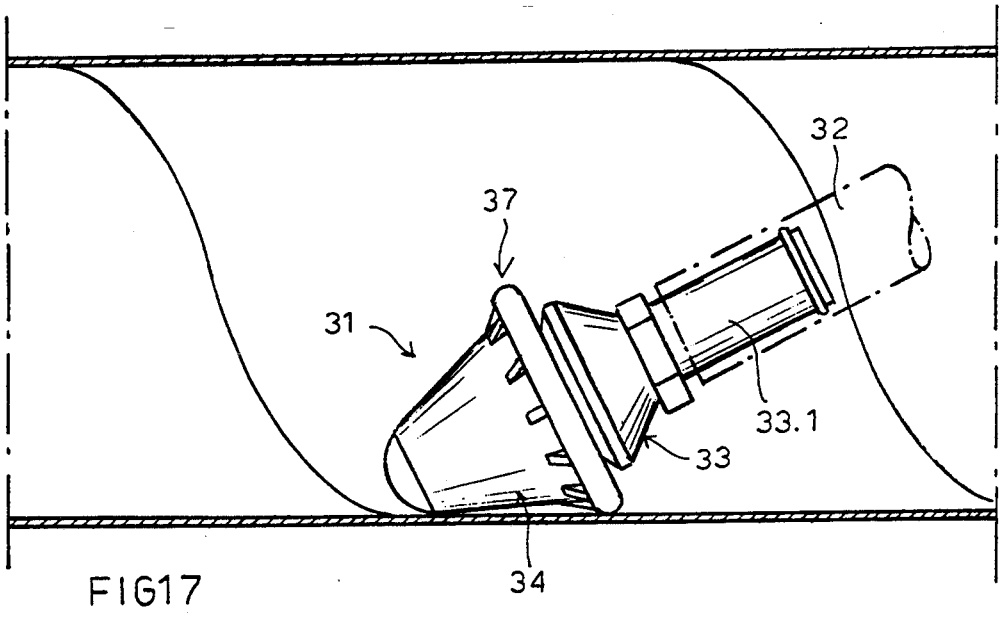
FIG. 17 shows the cleaning nozzle according to FIGS. 12 and 13 in a pipe-shaped duct.

Another alternative design of a cleaning nozzle 31, shown in FIGS. 14–17, comprises a rear piece 33, on which a rotateable front piece 34 is mounted, and an annular gap 36 therebetween. The rear piece 33 is provided with a coupling pipe 33.1 for a hose 32 on which the nozzle 31 is proposed to be arranged. This nozzle 31 snows mainly the same design features for the rest as the next above described nozzle. The front piece 34 also shows inner open grooves 34.5 extending in an angle to the radial through each groove as in the next above described alternative. However the front piece 34 is arranged rotatably on a shaft 35 by help of two radial ball bearings 38.1 and one axial ball bearing 38.2. In order to gain the ejection effect, which is present just at the annular gap 36, the front piece 34 is provided with an ejector ring 37 running along the annular gap 36 and kept in a distance from the front piece 34 by means of distance means 37.1. The ejector ring 37 and the distance means 37.1 can be made in one piece e.g. made of hard rubber, since the ejector ring 37 has the same effect as the friction ring which was mentioned above. The ejector ring 37 also can be made as two concentric rings with distance means them between which facilitates its mounting on the front piece 34. Alternatively the distance means can constitute an integrated portion of the front piece 34, since the ejector ring can be made completely smooth. A cross section of the ejector ring 37 is shown in FIG. 16 from which it is clear that the outer circumscribed surface 37.2 of the ejector ring 37 has an oval profile and its inner surface 37.3 has a straight profile. Air which is caused to pass the outer surface 37.2 of the ejector ring 37 by this is given a higher speed and a lower pressure than the air which is caused to pass through the ejector ring 37 at its inner surface 37.3. When the cleaning nozzle 34 is brought into contact with a wall in a duct this makes that the pressure of the air between the nozzle and the duct wall is lowered further making the cleaning nozzle 34 to contact the duct wall with an increased force compared with the designs described above. The contact of the cleaning nozzle 34 to the wall of the duct is gained more if the nozzle is brought in an angle to the wall. This will be achieved simply by designing the front piece 34 mainly conically tapered from the annular gap 36 to its nose causing the annular gap 36 to remain in the vicinity of the wall. By the projecting ejector ring 37 the desired inclination will be more ensured.

Figure 18:
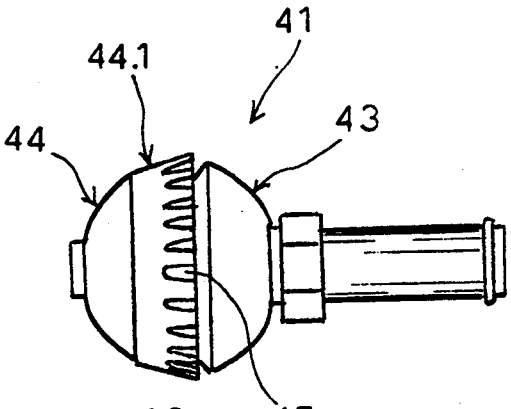
FIG. 18 shows a side view of another alternative design of the cleaning nozzle according to the invention.
Figure 19:
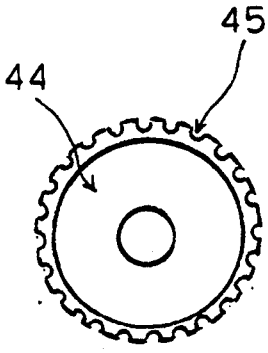
FIG. 19 shows a front view of the cleaning nozzle according to FIG. 18.
Figure 20:
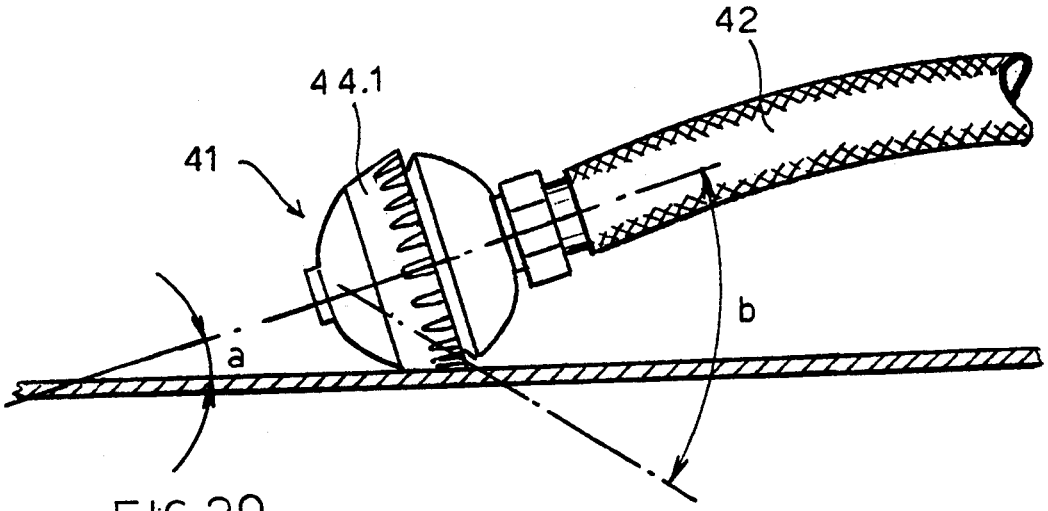
FIG. 20 shows the cleaning nozzle according to FIGS. 18 and 19 in contact with an inner wall in a duct.

An another alternative design of the cleaning nozzle 41 as shown in FIGS. 18–20 comprises a rear piece 43 on which a rotatable front piece 44 is mounted. The rear piece 43 is connected to a hose 42. The ejector ring according to the design described above is replaced by a number of grooves 45 extending along the periphery of the front piece 44 in the longitudinal direction of the cleaning nozzle 41. Air which is caused to flow between the inner wall of the duct and the cleaning nozzle is controlled by the grooves 45 in a way which improves the contact of the cleaning nozzle to the wall of the duct. In the figures the grooves 45 are shown extending in a distance from the rear edge of the front piece 44 and forward in a conical portion 44.1 directed forward on the front piece. The extension of the grooves 45 in the conical portion 44.1 can be varied and also extend along all of this portion. The conical portion 4.1 shows a cone angle of $a=15°$, but it can be between 10°–40°. If, as shown in the example, the conical surfaces which lead forwards to the annular gap 6 incline with a gap angle $b=50°$ the air discharging from the annular gap will be directed with an impact angle of 35° towards the ceiling surface. The gap angle b can be 30°–60° by which the impact angle can vary within the region 5°–40°, preferably 10°–20°, by selection of the cone angle a and/or the gap angle b.

In order to gain the effect of cleaning nozzles with rotating front pieces more these can be provided with a brush, preferably arranged along the periphery of each front piece, e.g. on the outer side of the ejector ring described above or just at the grooves in the front piece in the alternative design. It is also possible to arrange a circular brush at the nose of the rotating front piece.

In order to gain the contact of the cleaning nozzle to the inner wall of a pipe line of a magnetic material, which is most common as pipe lines as a rule are made of galvanized steel sheet, magnets, especially permanent magnets, can be arranged along the periphery of the cleaning nozzle. In that way e.g. the ejector ring described above can show magnet members along its periphery or the rotating nozzle can have such magnets arranged on the, relative to the hose, fixed rear piece or the rotating front piece.

I claim:

1. A process for cleaning pipe lines with a cleaning means having a longitudinal axis and which is connected via a supply conduit to a source of pressure medium, and wherein the cleaning means has at least one nozzle opening which is directed backwards towards the supply conduit at an acute angle relative to a center line which extends through a fastening of the supply conduit to the cleaning means, and wherein the nozzle opening is in the form of a substantially continuous annular gap which extends along the periphery of the cleaning means and which is connected to the supply conduit and the source of pressure medium, the medium being made to discharge through the annular gap and partly clean inner walls of a pipe line and force the cleaning means to move into the pipe line by the force resulting from the discharge of the pressure medium from the annular gap, said process including the steps of bringing the cleaning means into contact with an inner wall of a pipe line, and causing one part of the cleaning means to rotate around the longitudinal axis of the cleaning means so that as said one part of the cleaning means rotates in contact with the inner wall of a pipe line, the cleaning means is caused to move sideways relative to its longitudinal axis and follow a helical movement within the pipe line.

2. A process according to claim 1, further including the step of controlling the speed of movement of the supply conduit into the pipe line.

3. Cleaning arrangement for cleaning of pipe lines, comprising a cleaning means connected to a source of pressure medium via a supply conduit, said cleaning means comprising one or more nozzle openings which are directed backwards towards the supply conduit at an acute angle towards a center line which extends longitudinally through the cleaning means and a fastener which fastens the supply conduit to the cleaning means, said nozzle opening being in the form of a substantially continuous annular gap which extends along the outermost periphery of the cleaning means, wherein the cleaning means further comprises a rear piece having a connection means for the supply conduit and a front piece, the rear piece having an external conical surface extending to its outer periphery at its forward end, the front piece having a corresponding internal conical surface at its rear end, said conical surfaces being spaced from one another to define therebetween said annular which is directed back out towards said connection means, and the front piece is rotatable relative to the rear piece around a common axis of symmetry for said conical surfaces, and the front piece having a portion along its periphery for contacting the inner wall of a pipe line.

4. Cleaning arrangement according to claim 3, wherein said portion of the front piece has one or more friction members along the periphery thereof.

5. Cleaning arrangement according to claim 3, wherein the front piece has one or more driving means which are directed tangentially to an inner circle in the conical surface of the front piece which are actuated by the medium flowing through the cleaning means and making the front piece rotate.

6. Cleaning arrangement according to claim 3, wherein the cleaning means is provided with an ejector ring, said ejector ring being supported adjacent said annular gap in spaced relationship to one of said front and rear pieces.

7. Cleaning arrangement according to claim 3, wherein the front piece is provided with grooves arranged along its periphery.

* * * * *